US006338324B1

(12) United States Patent
Tanaka et al.

(10) Patent No.: US 6,338,324 B1
(45) Date of Patent: Jan. 15, 2002

(54) LUBRICATING STRUCTURE FOR A FOUR-STROKE ENGINE

(75) Inventors: Ryuji Tanaka; Katsuhiro Fukuda, both of Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 09/671,484

(22) Filed: Sep. 27, 2000

(30) Foreign Application Priority Data

Sep. 28, 1999 (JP) ..... 11-274834

(51) Int. Cl.[7] ..... F01M 9/10

(52) U.S. Cl. ..... 123/90.34; 123/196 M; 184/6.9

(58) Field of Search ..... 123/90.33, 90.34, 123/196 R, 196 M; 184/6.5, 6.9

(56) References Cited

U.S. PATENT DOCUMENTS 4,711,203 A * 12/1987 Seidl ..... 123/90.34
4,957,079 A * 9/1990 Nakatani et al. ..... 123/90.34
4,974,561 A * 12/1990 Murasaki et al. ..... 123/90.31

FOREIGN PATENT DOCUMENTS

JP 5-156917 6/1993
JP 7-139326 5/1995

* cited by examiner

*Primary Examiner*—Weilun Lo
(74) *Attorney, Agent, or Firm*—Finnegan, Henderson, Farabow, Garrett & Dunner, L.L.P..

(57) ABSTRACT

An intermittent oil supply system is provided that discharges intermittently some of the oil supplied to the cam bearing 53 from the oil supply path 71 formed on the axial center of the camshaft 4 and via the journal path 73 toward the side of the cam 68 and the tappet 48 in line with the rotation of the camshaft 4. The intermittent oil supply system is structured so that an oil groove 77 along the axial direction of the camshaft 4 is formed, for example, on the bearing surface 59*a* of said cam bearing 53, and at least one end of this oil groove 77 opens on the end face 59*b* of the cam bearing 53 (bearing housing 59).

1 Claim, 9 Drawing Sheets

LUBRICATING STRUCTURE FOR A FOUR-STROKE ENGINE

BACKGROUND OF THE INVENTION

Field of the Invention

The present invention relates to a lubricating structure for a four-cycle engine with an enhanced lubrication feature for a cam of a camshaft, a tappet, which is pressed by this cam, and a tappet holder by which the tappet is held.

II. Description of the Related Art

A direct cast DOHC type four-cycle engine is structured, for example, so that a cam formed on a camshaft directly presses the tappet of an intake-exhaust valve. A plurality of cam journals are formed along with a cam on a camshaft and these cam journals are supported by cam bearings provided on the cylinder head. Generally, a pair of cams is formed adjacent to a cam journal at both ends.

The camshaft is a hollow shaft and its interior is used as an oil supply path. A journal path that branches off at a right angle away from this oil supply path opens on the peripheral surface of the cam journal, and oil pumped out through the oil supply path is supplied between the cam journal and the cam bearing to lubricate them. At the same time, excess oil that has overflowed from a gap between the cam journal and the cam bearing causes lubrication between the cam and the tappet and between the tappet and the tappet holder.

However in, for example, a vertical four-cycle engine that can be mounted on a outboard motor and whose crankshaft and camshaft are disposed vertically, a cam and a tappet disposed at a higher position than the uppermost cam journal tend to be hardly lubricated, and lubrication conditions for the uppermost cam, the tappet, and the periphery of the tappet holder gets worse, resulting in seizure or uneven wear.

In this case, there may be a possibility of providing an exclusive oil path communicating with a periphery of the uppermost cam, the tappet and the tappet holder to lubricate them intensively. However, the structure of the engine becomes more complex by providing the oil path and oil is discharged continuously from the oil path. Therefore, the oil pressure of the entire engine decreases easily and there is concern that problems will occur in other lubricated portions within the engine. Therefore, this alternative design is not desirable.

SUMMARY OF THE INVENTION

The advantages and purposes of the invention will be set forth in part in the description which follows, and in part will be obvious from the description, or may be learned by practice of the invention. Moreover, the advantages and purposes of the invention will be realized and attained by means of the elements and combinations particularly pointed out in the appended claims.

The present invention was made in order to solve the above described exemplary problems. Hence, an exemplary objective is to provide a lubricating structure for a four-cycle engine that is simple, but enables oil to be supplied to cams that are in difficult locations to supply, and in the vicinity of the tappets and the tappet holders, without decreasing oil pressure and improving lubrication conditions to prevent seizure and uneven wear from occurring.

In order to achieve these exemplary objectives, the lubricating structure for a four-cycle engine related to the present invention comprises a camshaft having an oil supply path at the axial center thereof and formed with a cam adjacent to a cam journal for pressing a tappet, a journal path branched away from the oil supply path which opens into an opening on the outer peripheral surface of the cam journal so as to supply oil thereto and a cam bearing that supports this cam journal, and wherein an intermittent oil supply means which intermittently discharges some of the oil supplied to the cam bearing and the cam journal from the oil supply path intermittently through the journal path to the cam and the side of the tappet in line with the rotation of the camshaft.

Also, in the present invention relating to a lubricating structure for a four-cycle engine the intermittent oil supply means is preferably structured so that an oil groove is formed on the bearing surface of the cam bearing in alignment with the axial direction of the camshaft, and at least one end of this oil groove opens on an end face of the cam side of the cam bearing.

Furthermore, in the present invention relating to a lubricating structure for a four-cycle engine, the intermittent oil supply means is further structured so that an oil hole is formed for communicating between the bearing surface of the cam bearing and the end face of the cam side, and the axial direction of the opening of the oil hole on the bearing surface side coincides with the axial direction of the journal path that opens on the outer peripheral surface of the cam journal, and the axial direction of the oil hole is oriented to the cam side.

Moreover, in the present invention relating to a lubricating structure for a four-cycle engine, the intermittent oil supply means is still further structured so that a cylindrical tappet pressed by the cam is disposed adjacent to the bearing whereby the bearing surface of the cam bearing is formed with a wide portion and a narrow portion, the position in the axial direction in which the opening on the outer peripheral surface of the cam journal of the journal path is located where the rotational pathway of the journal path is limited to within the widest portion of the bearing surface and, the rotational pathway of the journal path is located outside the range of the narrowest portion of the bearing surface.

Furthermore, in the present invention relating to a lubricating structure for a four-cycle engine, the intermittent oil supply means is structured so that a cylindrical tappet pressed by the cam is located adjacent to the cam bearing and the bearing surface of the cam bearing is formed with a wide portion and a narrow portion, then an oil groove that extends in the axial direction of the camshaft is formed on the outer peripheral surface of the cam journal, and the positioning and length of the oil groove in the axial direction is disposed such that the rotational pathway of the entire oil groove is limited to within the range of the widest portion of the bearing surface and, moreover, one end of the oil groove is disposed at a location outside the narrowest portion of the bearing surface on the side of the tappet, and the journal path opens inside this oil groove.

It is to be understood that both the foregoing general description and the following detailed description are only exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DETAILED DESCRIPTION

Reference will now be made in detail to the present preferred embodiments of the invention illustrated in the accompanying drawings. Wherever possible, the same reference numbers are used throughout the drawings to refer to the same or like parts.

Figure 1:
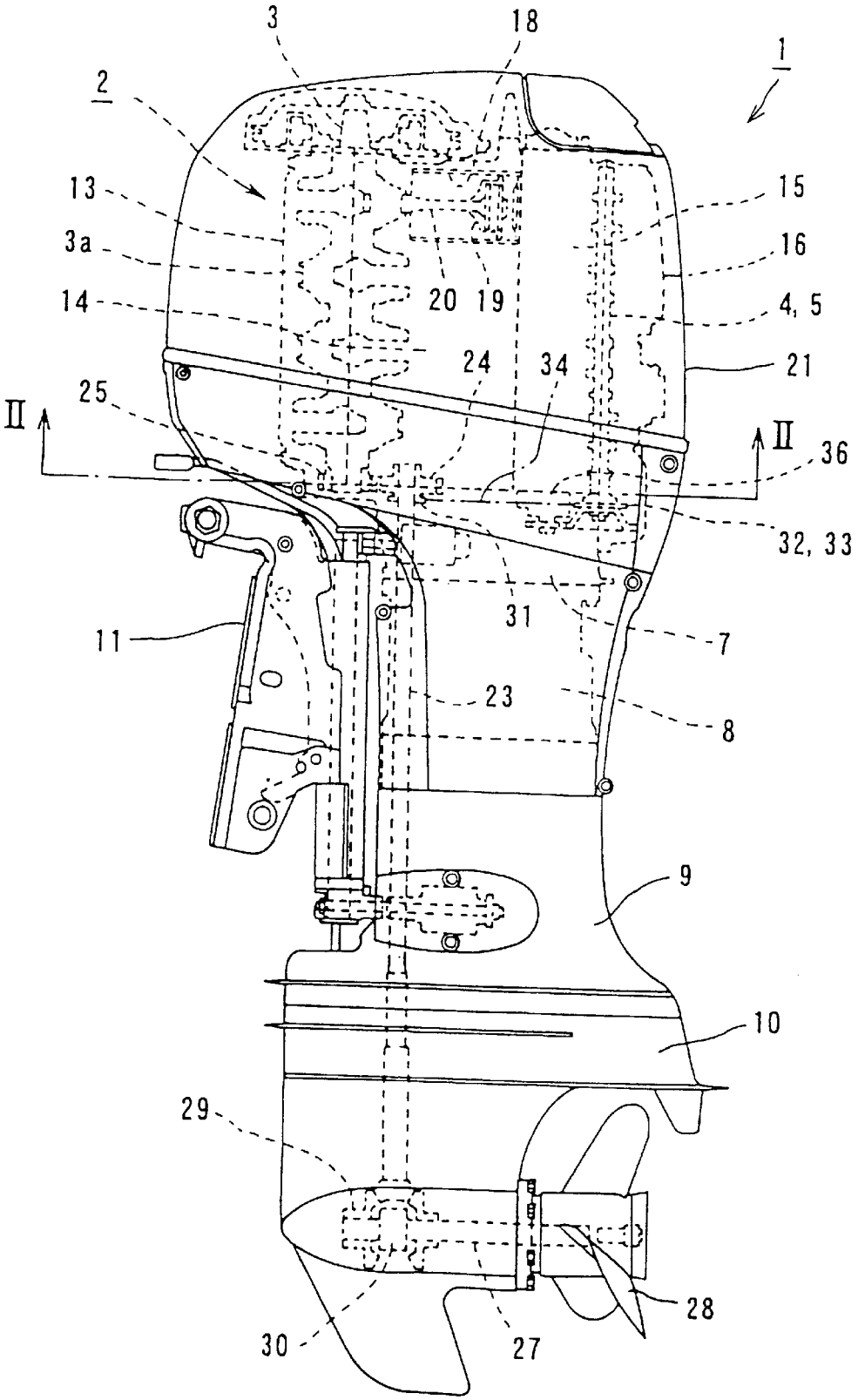
FIG. 1 shows a left side view of an example of an outboard motor wherein the present invention is incorporated.

Hereinafter, a preferred embodiment of the present invention will be described while referring to the drawings. FIG. 1 is a left side view of one example of an outboard motor wherein the invention is applied. The left side viewed from the front represents the front side (the hull side) while the right side represents the back side.

Disposed in the uppermost part of this outboard motor 1 is an engine 2 which is, for example, a direct cast DOHC series four cylinder, four-cycle engine and is fixed vertically on a substantially flat engine holder 7 so that crankshaft 3 and two camshafts 4, 5 face in the perpendicular direction. Fixed to the bottom surface of the engine holder 7 is an oil pan 8, and fixed under the oil pan 8 there are a drive housing 9 and a gear housing 10, in descending order. Further, provided in front of the engine holder 7 and the drive housing 9 is a clamp bracket 11 for attachment to the hull of a boat.

Figure 2:
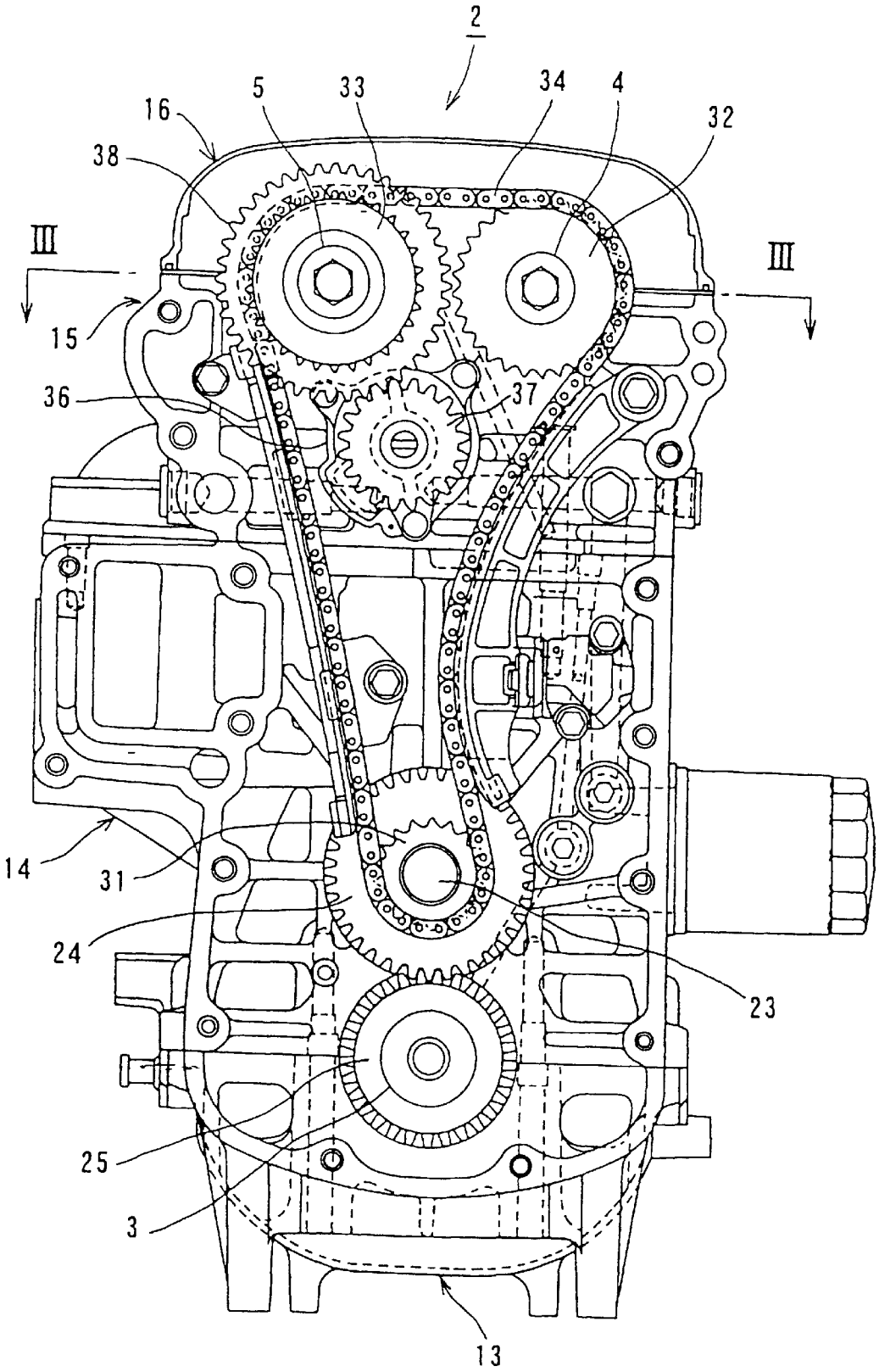
FIG. 2 is a bottom view of an engine viewed from the perspective of arrows II—II in FIG. 1.

As depicted in the lower portion of FIG. 2, the engine 2 comprises, in front to back order, a crankcase 13, a cylinder block 14, a cylinder head 15 and a head cover 16. The crankshaft 3 is supported between the crankcase 13 and the cylinder block 14, while two camshafts 4, 5 are supported within the cylinder head 15. The camshaft 4 on the right side as viewed from the front is the intake side camshaft, while the camshaft 5 at the left side viewed from the front is the exhaust camshaft.

Disposed horizontally and extending in a front-rear direction within the cylinder block 14 are four cylinder bores 18 formed in a single top to bottom row; a piston 19 is inserted within each cylinder bare 18 so as to slide freely and they are connected by a con rod 20 to the crank pin 3*a* for crankshaft 3. Reciprocating movement of the piston 19, each cylinder bore 18 rotates the crankshaft 3. The entire engine 2, the engine holder 7 and the oil pan 8 are covered over by an engine cover 21 made of a synthetic resin to protect them from water.

A drive shaft 23 is supported by being passed vertically through the inside of the engine holder 7, the oil pan 8, the drive housing 9 and the gear housing 10. This drive shaft 23 is offset slightly toward the rear way from the axis line of the crankshaft 3, and provided on the upper end of the crankshaft 3 is a driven gear 24 that turns integrally therewith. Provided on the lower end of the crankshaft 3 is a drive gear 25 that turns integrally therewith and that engages the driven gear 24, and so rotation of the crankshaft 3 is transmitted to the drive shaft 23.

Provided horizontally and supported in a front-rear direction within the gear housing 10 is a propeller shaft 27, and provided at the rear end of the propeller shaft 27 is a screw propeller 28 that rotates integrally therewith. Provided at a point where the propeller shaft 27 and the drive shaft 23 cross each other are a bevel gear mechanism 29 and a clutch shifter 30. Rotation of the drive shaft 23 is transmitted to the propeller shaft 27 via the bevel gear mechanism 29 and the screw propeller 28 is driven rotationally to generate propulsion. Since the fixed rotation direction of the drive shaft 23 switches between forward and reverse by the clutch shifter 30 and the rotation is transmitted to the propeller shaft 27, the direction of the outboard motor 1 (the hull of a boat) can be selected between forward and reverse.

Provided on the bottom of the driven gear 24 provided on the upper end of the drive shaft 23 is a drive sprocket 31 that rotates integrally therewith, and a timing chain 34 is wound between the drive sprocket 31 and the driven sprockets 32, 33 provided integrally at the lower ends of the respective camshafts 4, 5 that rotate integrally therewith. Accordingly, the rotation of the drive shaft 23, namely, the rotation of the crankshaft 3, is transmitted to the camshafts 4, 5.

Provided on the bottom of the engine 2 (cylinder head 15) is an oil pump 36, and provided on the main shaft of the oil pump 36 is a pump driven gear 37 which is engaged with, for example, a pump drive gear 38 provided on the bottom of the driven sprocket 33 on the camshaft 5 on the exhaust side. Accordingly, when the engine 2 operates, the oil pump 36 is driven together therewith and oil stored within the oil pan 8 is pumped up and then pressure fed inside the engine 2 for lubrication. After the inside of the engine 2 has been lubricated, the oil drops through a plurality of oil return holes opened on the bottom of the engine 2 and is returned to the oil pan 8.

Figure 3:
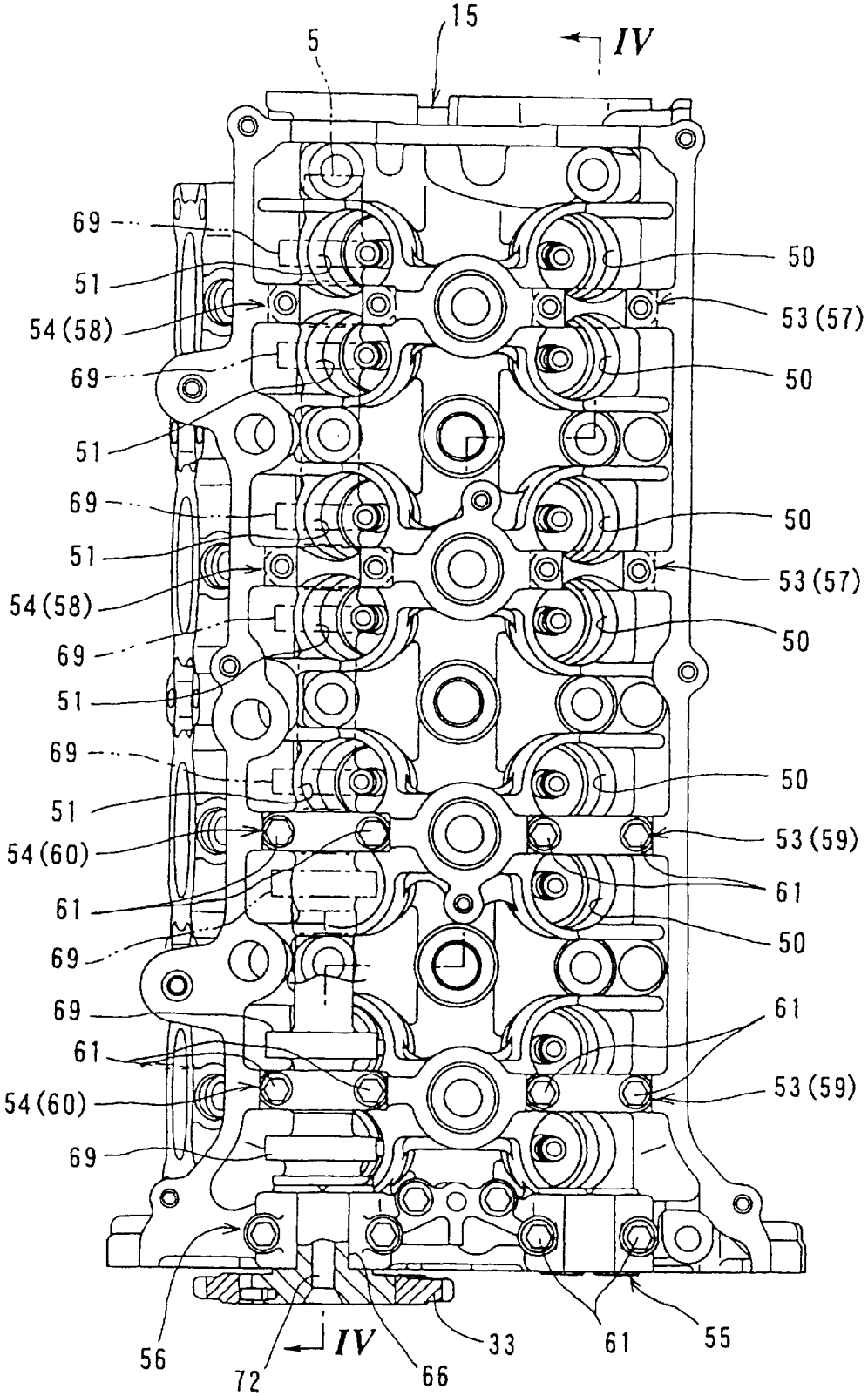
FIG. 3 is a rear view of the cylinder head viewed from the perspective of arrows III—III in FIG. 2.
Figure 4:
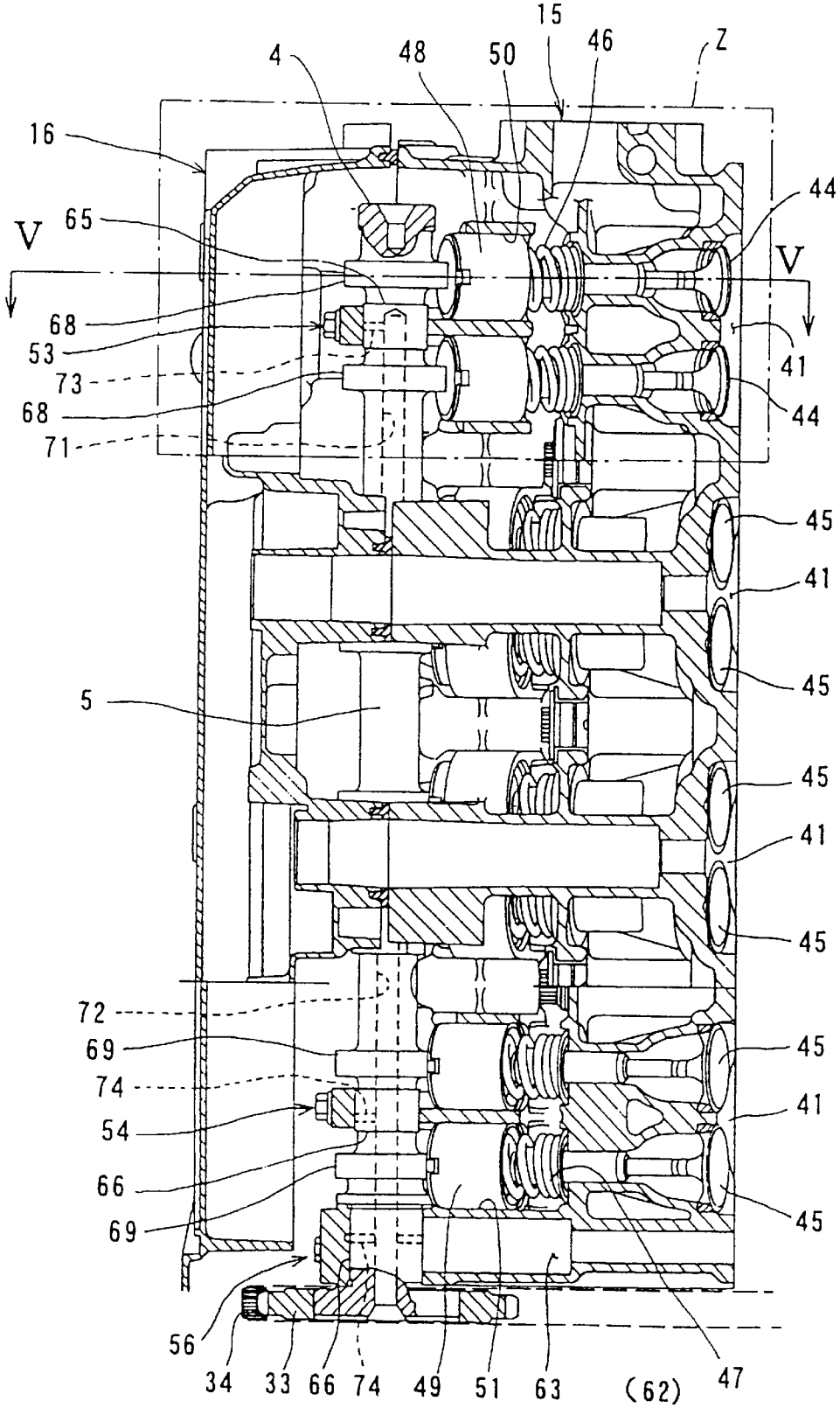
FIG. 4 is a vertical cross-sectional view of the cylinder head along lines IV—IV in FIG. 3.
Figure 5:
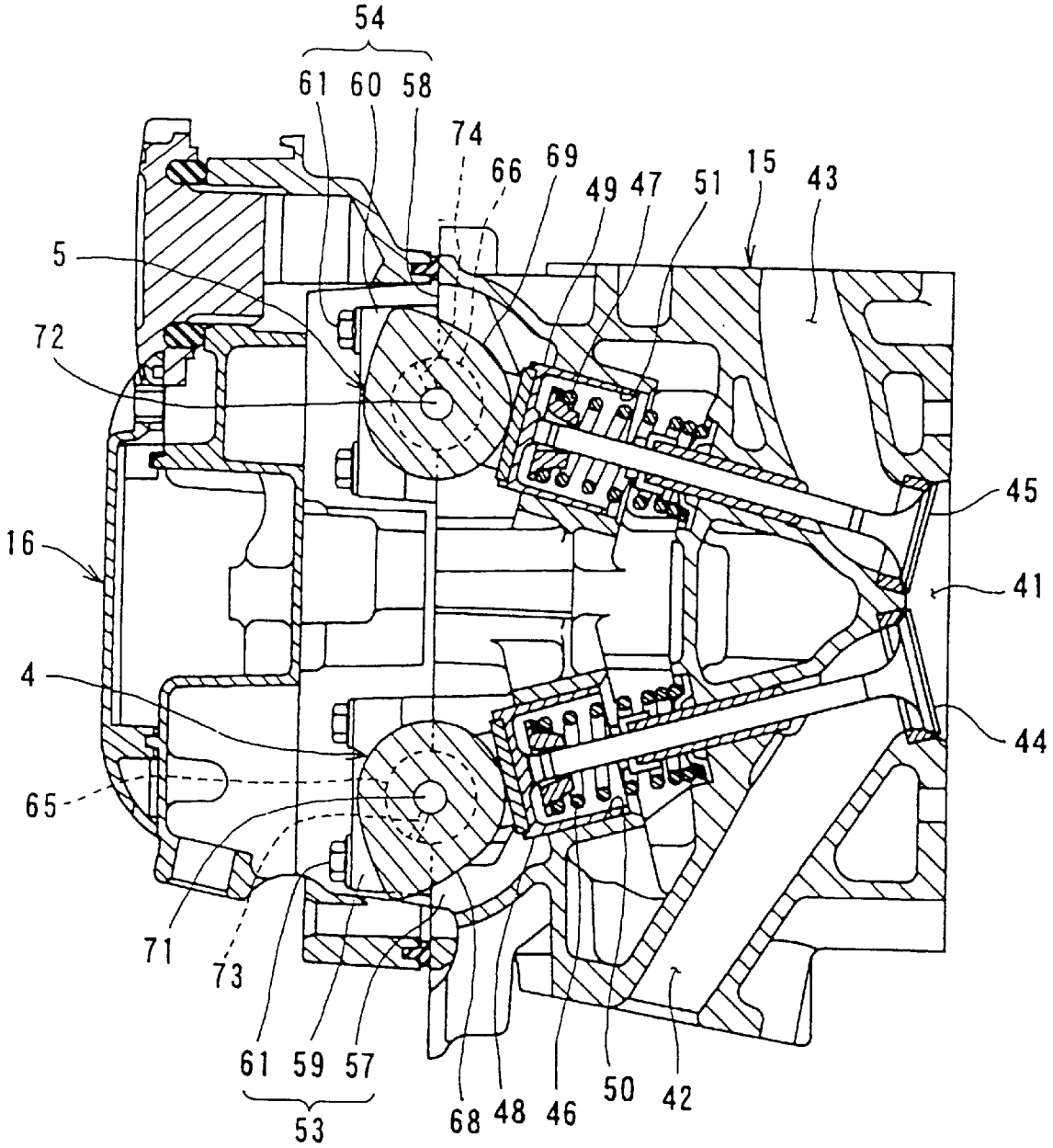
FIG. 5 is a horizontal cross-sectional view of the cylinder head along lines V—V in FIG. 4.

FIG. 3 is a rear view of the cylinder head 15 viewed from the direction of arrows III —III in FIG. 2. FIG. 4 is a vertical cross section of the cylinder head 15 along lines IV—IV in FIG. 3. FIG. 5 is a horizontal cross section view along lines V—V in FIG. 4.

As shown in FIGS. 4 and 5, in the front surface of the cylinder head 15, four combustion chambers 41 that integrate with the cylinder bores 18 of cylinder block 14 are formed in concave configuration, and intake ports 42 and exhaust ports 43 that lead to these combustion chambers 41 are formed. For example, intake ports 42 are opened on the right side surface of the cylinder head 15, and the exhaust ports 43 are opened on the left side surface thereof.

The eight respective intake valves 44 and exhaust valves 45 that open and close the intake ports 42 and exhaust ports 43 are housed inside the cylinder head 15. The intake valves 44 and the exhaust valves 45 are always powered, such that they are in the closed direction, by valve springs 46 and 47, respectively, and each pulse spring 46 . . . and 47 . . . is sheathed in a cylindrical tappet 48 and 49, respectively, (refer to FIG. 5). Each tappet 48 and 49 is inserted in an airtight manner within a tappet holder 50 and 51 shaped like a cylindrical hole formed on each cylinder head 15 so as to slide freely therein.

As shown in FIG. 3, between the two tappet holders 50, 51 formed on the intake side and the exhaust side of each cylinder, a total of four cam bearings 53, 54 respectively, are provided. Also, cam bearings 55, 56 are provided in the lowermost portion of the cylinder head 15 at, respectively, the intake side and the exhaust side.

As shown in FIGS. 5–9, each cam bearing 53 (55), 54 (56) is structured so that each separate bearing housing 59, 60 is fastened by two bolts 61 to the bearing base 57, 58 that are each integrally formed in the cylinder head 15 side. The lowermost cam bearings 55, 56 are formed larger in width in the axial direction than other cam bearings 53, 54, and a head oil path 62, 63 (refer to FIG. 4) that communicates with the outlet of the oil pump 36 is formed within the bearing base.

In the camshafts 4, 5 are formed five cam journals 65, 66, respectively, in the axial direction, and these cam journals 65, 66 are supported so as to freely rotate on the cam bearings 53, 55 and the cam bearings 54, 56, respectively. Up to the fourth cam journals 65, 66 are formed pairs comprising, respectively, intake cams 68 and exhaust cams 69 at both sides in the axial direction. These intake cams 68 and exhaust cams 69 integrate with the position of the respective tappets 48, 49, the tappets 48, 49 are pressed by the rotation of the camshafts 4, 5, and the intake and exhaust valves 44, 45 are opened and closed at a predetermined timing against the closing force of the valve springs 46, 47.

The camshafts 4, 5 are hollow shafts and oil supply paths 71, 72 are formed therein. Journal paths 73, 74 which branch off at a right angle from the oil supply paths 71, 72 at the location of each cam journal 65, 66, opens onto the outer peripheral surface of the cam journal 65, 66, respectively.

When the engine 2 starts and the oil pump 36 is driven, some of the oil that is pumped out by the oil pump 36 is supplied to the cam bearings 55, 56 at the lowermost point through the head oil paths 62, 63. Furthermore, the oil is supplied to the upper cam bearings 53, 54 and the cam journals 65, 66 via the journal paths 73, 74 at the lowermost point, as well as the oil supply paths 71, 72 within the camshafts 4, 5 and other journal paths 73, 74. As a result, every cam journal 65, 66, cam bearing 53, 54, and the space between 55 and 56 is lubricated.

Excess oil flows down from between each cam journal 65, 66 and cam bearing 53, 54, and gaps between every intake and exhaust cam 68, 69 and tappet 48, 49 located below each cam bearing 53, 54 as well as the area between the tappets 48, 49 and the tappet holders 50, 51 are lubricated.

However, as it is not desirable that excess oil from the uppermost cam bearings 53, 54 be supplied to the intake and exhaust cams 68, 69, as well as the tappets 48, 49 and the tappet holders 50, 51, there is concern that poor lubrication may occur in these locations. Accordingly, an intermittent oil supply means is provided to the uppermost cam bearings 53, 54 and the cam journals 65, 66 so that some of the oil supplied thereto is discharged intermittently toward the uppermost intake and exhaust cams 68, 69, and the tappets 48, 49, in line with the rotation of the camshafts 4, 5. Hereinafter, four embodiments of the intermittent oil supply means having a camshaft 4 at the intake side and a cam bearing periphery 53 will be described.

Figure 6:
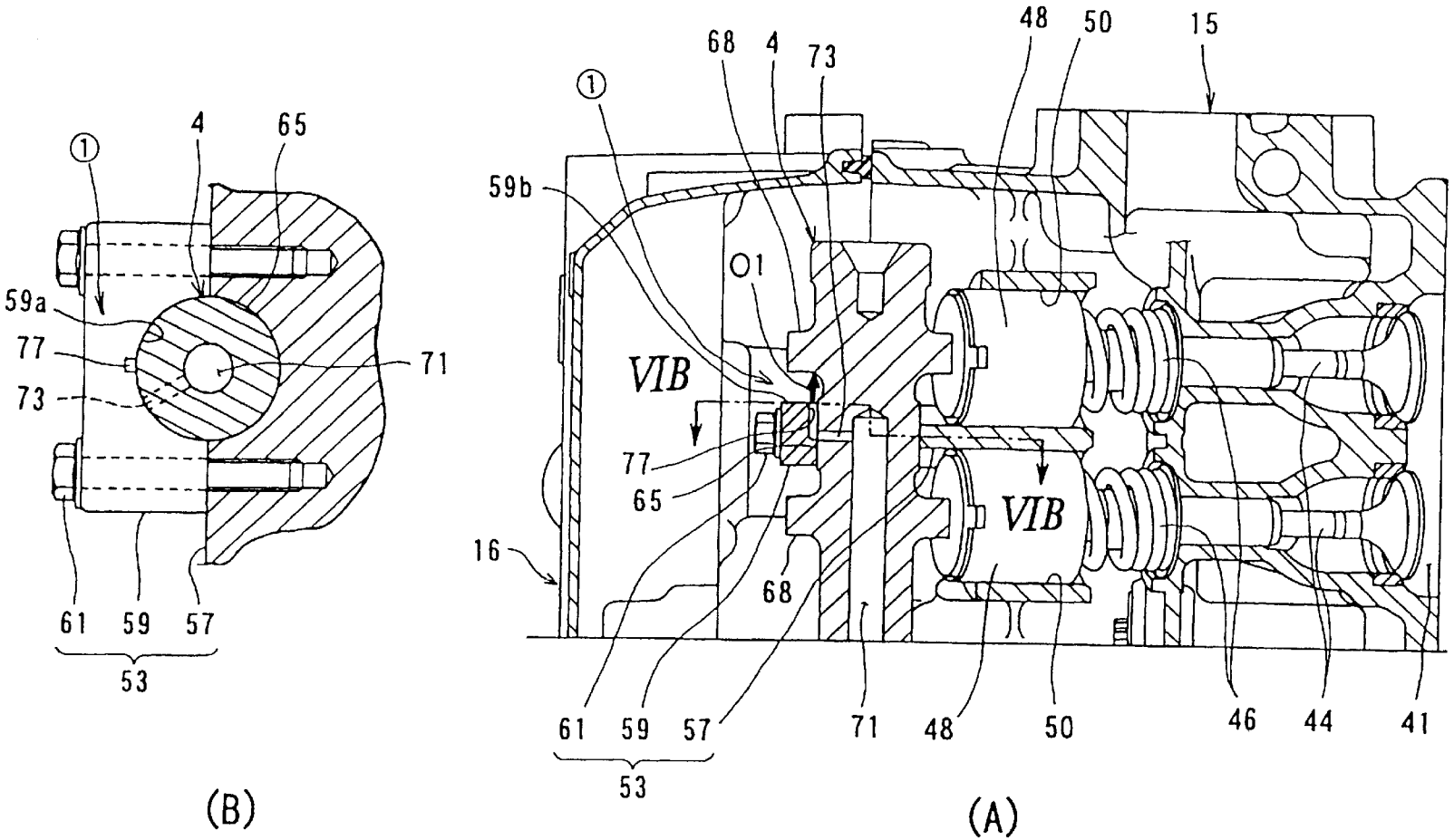
FIG. 6(A) is an expanded cross-sectional view of the section marked Z in FIG. 4 of a first embodiment of the intermittent oil supply means.
FIG. 6(B) is a cross-sectional view from the perspective of the arrows VIB—VIB in FIG. 6(A)

FIGS. 6 (A) and (B) show the first embodiment of an intermittent oil supply means ①. As shown herein, for example, in the cam bearing 53 that supports the uppermost cam journal 65 of the intake side camshaft 4, an oil groove 77 is formed that extends in the axial direction of the camshaft 4 in the bearing surface 59*a* of this bearing housing 59 (shown in FIG. 6 (B)) . The upper end of this oil groove 77 opens at the end face 59*b* (shown in FIG. 6 (A)) of the upper side of the bearing housing 59, while the lower end of the oil groove 77 extends up to the position where the journal path 73 opens on the outer peripheral surface of the cam journal 65.

By providing the oil groove 77 as an intermittent oil supply means 1, whenever the camshaft 4 turns, the journal path 73 that opens on the outer peripheral surface of the cam journal 65 coincides with the oil groove 77. Some of the oil supplied via the journal path 73 is spouted out intermittently in the upward direction indicated by arrow O1 and splashes over the intake cam 68, the tappet 48, and the tappet holder 50 that are located directly above the cam bearing 53, and lubricates them. Accordingly, lubrication conditions for the uppermost intake cam 68, tappet 48, and tappet holder 50 located at what are conventionally hard areas to supply oil are improved. As a result, seizure or uneven wear are prevented from occurring.

Also, as described above, by only forming the oil groove 77, the intermittent oil supply means ①is structured extremely simply and easily. Moreover, if the oil groove 77 is formed by casting at the same time that the bearing housing 59 is die-casted or forged, the oil groove 77 can be formed more easily and inexpensively without machining.

Figure 7:
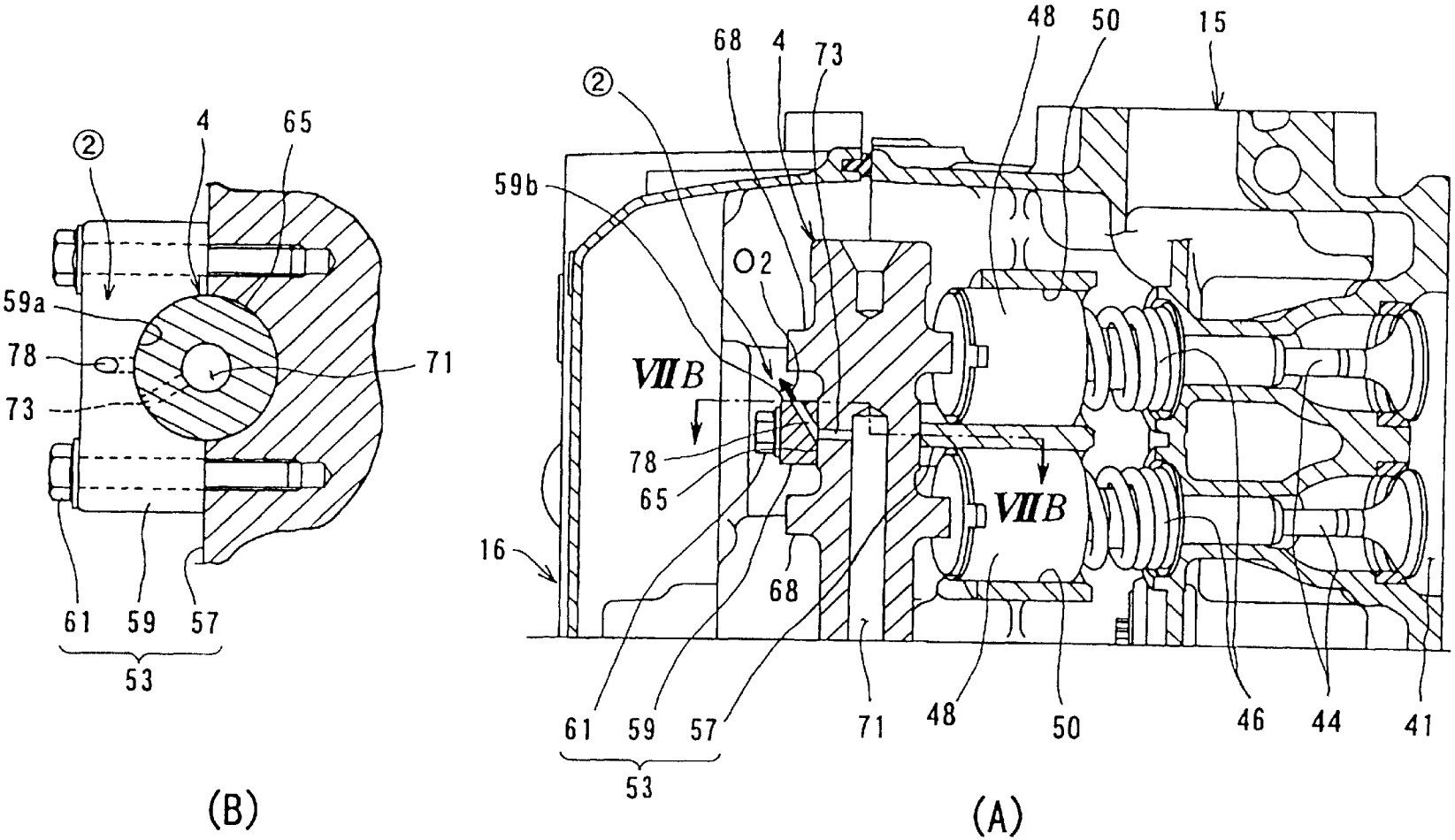
FIG. 7(A) is an expanded cross-sectional view of the section marked Z in FIG. 4 of a second embodiment of the intermittent oil supply means.
FIG. 7(B) is a view from the perspective of lines $VII_B$—$VII_B$ in FIG. 7A.

FIGS. 7 (A) and (B) show the second embodiment of the intermittent oil supply means ②. Herein, in the cam bearing 53 that supports the uppermost cam journal 65 of the camshaft 4, an oil hole 78 having an inclined hole configuration and that communicates between the bearing surface 59*a* (shown in FIG. 6 (B)) of this axle housing 59 and the upper side of end face 59*b* (shown in FIG. 6 (A)) on this bearing housing 59. The position of the opening in the axial direction of the oil hole 78 on the bearing surface 59*a* side coincides with the axial direction of the journal path 73 that opens on the outer peripheral surface of the cam journal 65, and the axial direction of oil hole 78 is oriented to the uppermost intake cam 68.

By providing the oil hole 78 as an intermittent oil supply means ②, whenever the camshaft 4 turns, the journal path 73 which opens on the outer peripheral surface of the cam journal 65 coincides with the opening of the oil hole 78 at the bearing surface 59*a* side. Some oil that is supplied from the journal path 73 spouts out intermittently toward the uppermost intake cam 68 as indicated with an arrow 02 and lubricates the uppermost intake cam 68, the tappet 48, and the tappet holder 50. In this case, too, because the oil hole 78 can be formed extremely easily, the intermittent oil supply means ② can be structured in a simple manner.

Figure 8:
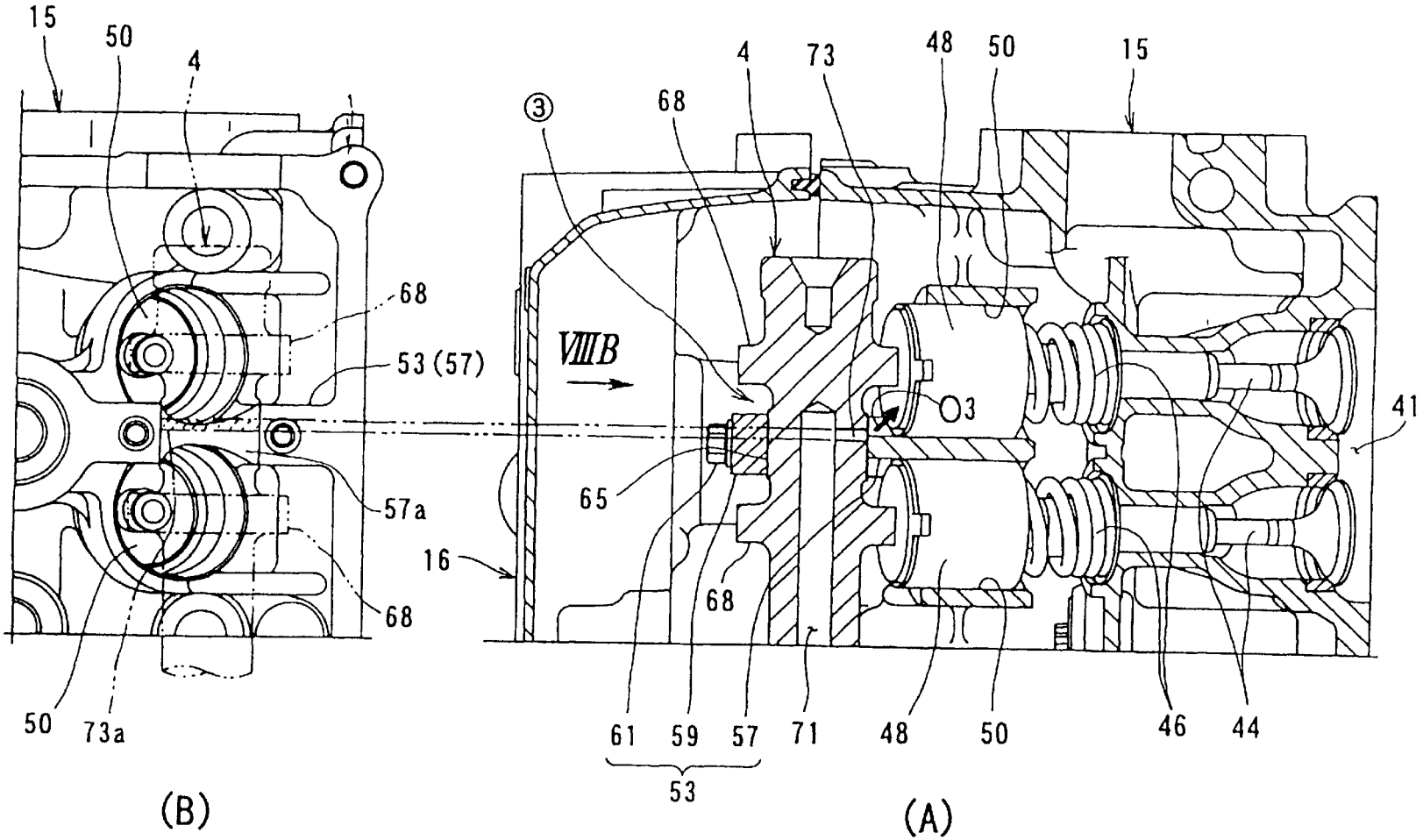
FIG. 8(A) is an expanded cross-sectional view of the section marked Z in FIG. 4 of a third embodiment of the intermittent oil supply means.
FIG. 8(B) is a cross-sectional view from the perspective of the arrow $VIII_B$ in FIG. 8A.

FIG. 8 (A) and FIG. 8 (B) show the third embodiment of the intermittent oil supply means ③. As shown herein, the tappets 48 (tappet holders 50) are disposed adjacent to both sides of the cam bearing 53 (bearing base 57), and the configuration of the bearing surface 57*a* (refer to FIG. 8 (B)) of the bearing base 57 is formed so that the width in the axial direction in the central part in the peripheral direction is narrower than the width in the axial direction at both ends in the peripheral direction so as to look like a cross sectional configuration of a concave lens.

In the cam journal 65 at the uppermost point of the camshaft 4, the position in the axial direction where the journal path 73 opens is structured so that the rotational pathway 73*a* of the journal path 73 is limited to within the widest portion of the bearing surface 57*a* on the bearing base 57. Moreover, the rotational pathway 73*a* of the journal path 73 is set so as to be positioned outside the narrowest region of the bearing surface 57*a* toward the side of the upper tappets 48 (tappet holders 50). This structure constitutes the intermittent oil supply means ③.

When structured as described above, whenever the camshaft 4 turns, the journal pathway 73 of the cam journal 65 is displaced from the widest portion to the narrowest portion of the bearing surface 57*a*. At this time, the opening of the journal pathway 73 is released and, once per revolution, oil spouts out intermittently from the journal path 73 as indicated by arrow O3. This intermittently spouted oil splashes over the tappet 48 and the tappet holder 50 first, and then splashes over onto the intake cams 68. As a result, the tappet 48, the tappet holder 50 and the intake cam 68 are well lubricated.

According to this structure, by only displacing the processing position of the journal pathway 73 slightly toward the upper end of the camshaft 4, the intermittent oil supply means ③ is completed. This enables the intermittent oil supply means ③ to be made extremely easily and at a small working cost.

Figure 9:
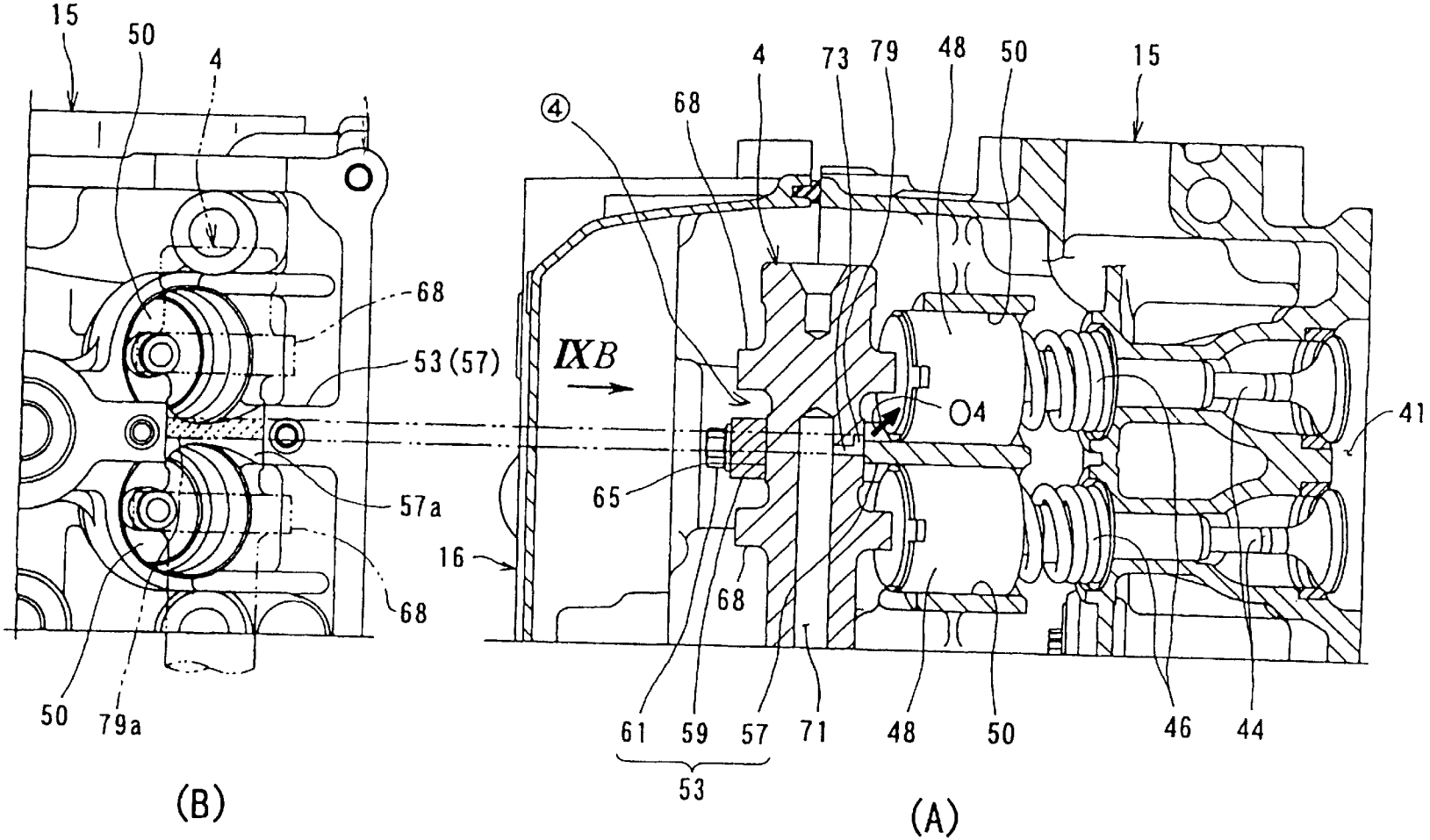
FIG. 9(A) is an expanded cross-sectional view of the section marked Z in FIG. 4 of a fourth embodiment of the intermittent oil supply means.
FIG. 9(B) is a cross-sectional view from the perspective of arrow IXB in FIG. 9A.

FIG. 9 (A) and (B) show intermittent oil supply means ④ as the fourth embodiment. In this case, too, the tappets 48 (tappet holders 50) are disposed adjacent to the cam bearing 53 (bearing base 57) at both sides, whereby the configuration of the bearing surface 57*a* of the bearing base 57 is formed so that the width in axial direction in the central part in the peripheral direction is narrower than the width in the axial direction at both ends in the peripheral direction.

On the peripheral surface of the cam journal 65 at the uppermost part of the camshaft 4, a short oil groove 79 is formed extending in the axial direction of the cam shaft 4. The axial position of this oil groove 79 is structured so that the rotational pathway 79*a* of the oil groove 79 is limited to within the range of the widest portion of the bearing surface 57*a* of the bearing base 57. Moreover, the rotational pathway 79*a* of the oil groove 79 is set so that one end (the upper end) of the oil groove 79 is positioned outside the range of the narrowest portion of the bearing surface 57*a* on the upper tappets 48 (tappet holders 50) side. The journal path 73 opens at the lower end side of the oil groove 79. In this way, the intermittent oil supply means ④ is structured.

According to this structure, every time the camshaft 4 turns, the upper end of the oil groove 79 on the cam journal 65 protrudes upwardly from the narrowest portion of the bearing surface 57*a*. Oil supplied from the journal path 73 spouts out intermittently from the upper end of the oil groove 79 once per revolution in the direction indicated by arrow 04. As in the third embodiment, the tappet 48, the tappet holder 50, and the intake cam 68 are well lubricated by oil that is intermittently spouted in this manner.

According to the intermittent oil supply means ① through ④ as described in the first through the fourth embodiments, by using an extremely simple structure, an appropriate amount of oil is supplied to the tappets 48, the tappet holders 50, the intake cams 68, etc., which are located in places where it is conventionally hard to supply oil, lubrication conditions among these components are improved, and seizure and uneven wear are effectively prevented from occurring.

Further, because the intermittent oil supply means ① through ④ supplies oil intermittently, rather than continuously, to the necessary locations, there is no need to worry about the oil pressure within the engine 2 dropping or about other portions to be lubricated being adversely affected. Also, excess oil does not splash around, and so the oil does not spout out from the breather outlet (not shown) provided on the head cover 16.

In the above descriptions of the first through the fourth embodiments, descriptions were made by using examples in which the intermittent oil supply means ① through ④ are provided in the cam journal 65 and the cam bearing 53 provided in the uppermost camshaft 4 at the intake side. However, it is possible to provide the same intermittent oil supply means to mid-positioned cam bearing 53 and cam journal 65, as well as to the cam bearing 54 and the cam journal 66 of the exhaust side camshaft 5. The descriptions of these embodiments were made by using examples whereby the present invention is applied to vertical engines of which crankshaft 3 is disposed vertically. However, the present invention is also applicable to horizontal type engines for which a crankshaft is disposed horizontally (vehicle engine, etc.)

As described above, according to the lubricating structure for a four-cycle engine related to the present invention, oil can be supplied to the vicinity of cams and tappets located in positions to which it is conventionally hard to supply oil by using a simple structure and without decreasing oil pressure in the engine, whereby lubrication conditions are improved, and seizure and uneven wear can be prevented.

Other embodiments of the invention will be apparent to those skilled in the art from consideration of the specification and practice of the invention disclosed herein. It is intended that the specification and examples be considered as exemplary only. Thus, it should be understood that the invention is not limited to the illustrative examples in this specification. Rather, the invention is intended to cover all modifications and variations that come within the scope of the following claims and their equivalents.

What is claimed is:

1. A lubricating structure for a four-cycle engine comprising:

a camshaft having an oil supply path at an axial center thereof and formed with a cam for pressing a tappet adjacent to a cam journal;

a journal path bifurcating from the oil supply path and having an opening on an outer peripheral surface of the cam journal so as to supply oil thereto and to a cam bearing that supports the cam journal;

at least one intermittent oil supply device configured to intermittently spout oil supplied to the cam bearing and to the cam journal from the oil supply path, through the journal path, and toward the cam and the tappet in line with the rotation of the camshaft; and wherein the intermittent oil supply device is structured so that a cylindrical tappet that is pressed by the cam is disposed adjacent to the cam bearing and the bearing surface of the cam bearing is formed with a wide portion and a narrow portion, and a rotational pathway defined by said journal path opening is positioned within said wide portion and outside said narrow portion so as to open substantially towards said tappet.

* * * * *